US006131198A

United States Patent [19]

Westrick

[11] Patent Number: 6,131,198

[45] Date of Patent: Oct. 17, 2000

[54] TACTICAL VEST CARRIER WITH RELEASABLY SECURABLE POCKET CONTAINING A HOLSTER

[75] Inventor: Aaron Jude Westrick, Boyne City, Mich.

[73] Assignee: Second Chance Body Armor, Inc., Central Lake, Mich.

[21] Appl. No.: 09/313,041

[22] Filed: May 17, 1999

[51] Int. Cl.[7] ..... F41H 1/02; F41C 33/00

[52] U.S. Cl. ..... 2/102; 2/2.5; 2/94; 2/252; 224/911; 224/901.6

[58] Field of Search ..... 2/2.5, 102, 94, 2/96, 247, 249–253, 77, 115; 224/911, 901.6

[56] References Cited

U.S. PATENT DOCUMENTS

| | | | |
|---|---|---|---|
| 1,308,378 | 7/1919 | Tragardh | 2/252 |
| 1,310,282 | 7/1919 | Clark | 2/252 |
| 2,593,795 | 4/1952 | Rhoads et al. | 2/247 |
| 2,743,446 | 5/1956 | Persico et al. . | |
| 3,537,108 | 11/1970 | Daniels | 2/252 |
| 3,843,969 | 10/1974 | George et al. . | |
| 4,106,121 | 8/1978 | Belson . | |
| 4,235,356 | 11/1980 | Atchisson . | |
| 4,446,573 | 5/1984 | Green | 2/252 |
| 4,966,320 | 10/1990 | DeSantis et al. . | |
| 5,170,919 | 12/1992 | DeSantis et al. . | |
| 5,246,153 | 9/1993 | Beletsky . | |
| 5,379,461 | 1/1995 | Wilmers | 2/115 |
| 5,431,318 | 7/1995 | Garcia . | |
| 5,495,620 | 3/1996 | Schoenweiss et al. . | |
| 5,495,967 | 3/1996 | Parton | 224/911 |
| 5,509,147 | 4/1996 | Busquets | 2/253 |
| 5,644,792 | 7/1997 | Tishler et al. . | |
| 5,689,829 | 11/1997 | Rose | 2/77 |
| 5,829,060 | 11/1998 | Falk et al. | 2/102 |

*Primary Examiner*—John J. Calvert
*Assistant Examiner*—Tejash Patel
*Attorney, Agent, or Firm*—Thomas J. Ring; Wildman, Harrold, Allen & Dixon

[57] ABSTRACT

A tactical vest carrier to be worn over the clothing at a torso region of the wearer. The carrier has a front carrier section and a back carrier section for holding ballistic body armor items. The carrier has a pocket extending outwardly from the front carrier section with the pocket being sized for holding a handgun holster. The pocket includes a front flap having a top section, a bottom section, a fixed side section and a releasably securable side section. The bottom section, a fixed portion of the top section and the fixed side section are fixedly secured a pocket backing. A releasable portion of the top section and the releasably securable side section are releasably secured to the pocket backing of the tactical vest carrier.

20 Claims, 2 Drawing Sheets

FIG. 4
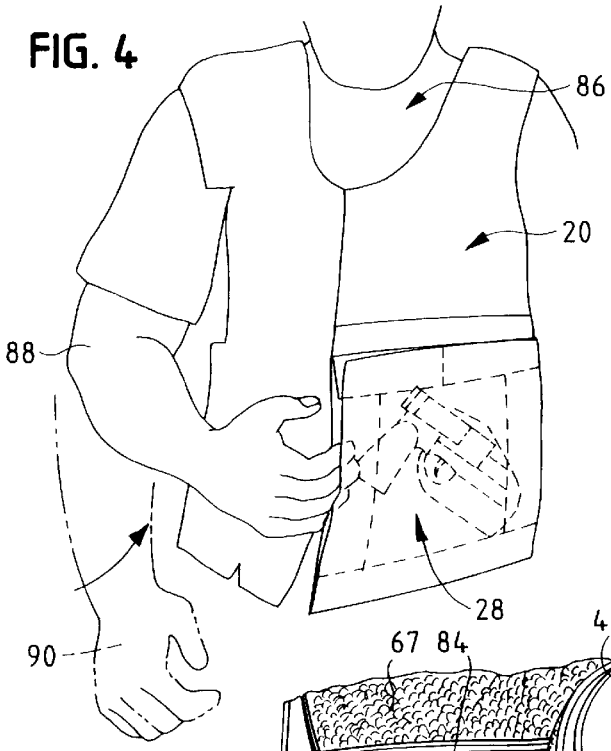
FIG. 5
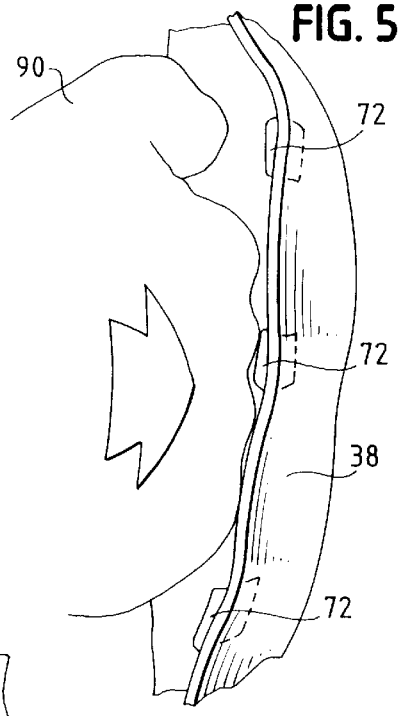
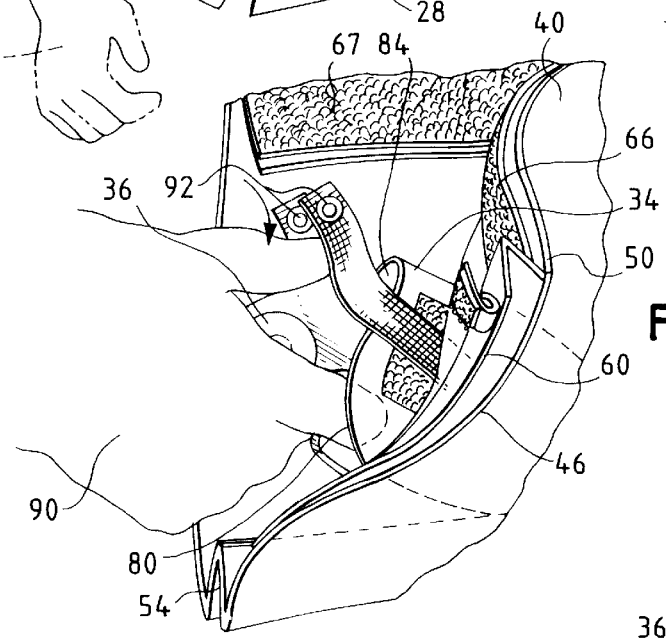
FIG. 6
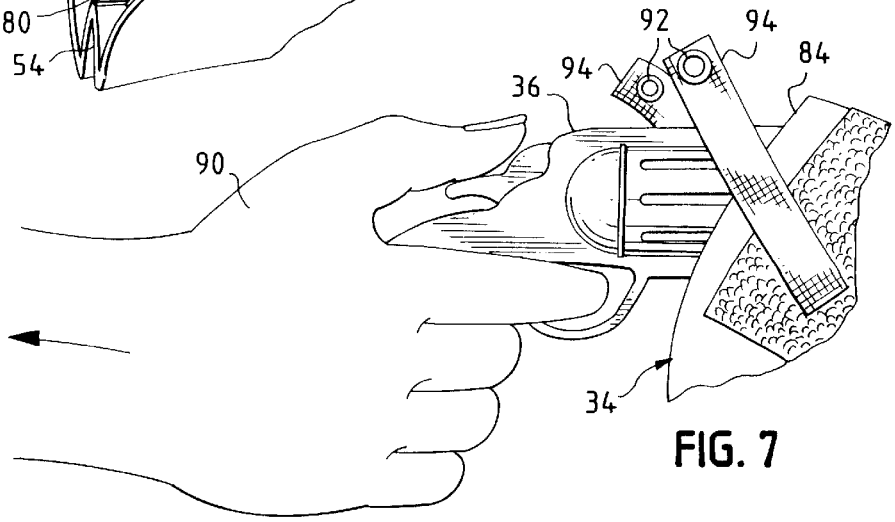
FIG. 7

TACTICAL VEST CARRIER WITH RELEASABLY SECURABLE POCKET CONTAINING A HOLSTER

FIELD OF THE INVENTION

The present invention relates to protective garments for resisting ballistic forces and more particularly to tactical body armor garments having exterior pockets.

BACKGROUND OF THE INVENTION

Tactical body armor garments which are worn over the clothing of a user, such as specialized law enforcement or military personnel, often have various pockets and straps for carrying tactical gear. Tactical body armor vests generally have an outer carrier made of a durable cloth material such as polyester or nylon which contains and houses one or more ballistic pads often accompanied by a steel and/or ceramic rifle plate. The ballistic resistant pads are formed of high strength penetration resistant materials such as aramid fibers, composite materials and the like. When utilizing one or more rifle plates the tactical vests are capable of preventing penetration from high caliber ballistic rounds including assault rifle rounds for vests meeting certain Threat Level standards.

The outer cloth carriers of tactical vests often include one or more pockets for carrying a variety of items and equipment which may be used in a potentially life threatening situation. It is common for tactical officers and military personnel to carry a back-up handgun along with a primary weapon such as a rifle. The back-up handgun may be used if the primary weapon becomes ineffective or is not readily useable by the tactical vest wearer.

Certain vest garments have pockets which are used to hold an inserted handgun. However, such pockets are opened from the top to gain access to the handgun. The top of the pocket is entirely opened and both sides of the pocket are also both released from the pocket backing such that the front of the pocket drapes forward exposing the handgun. These vest pockets having both the entire top end and both side ends of the pockets being disengaged have certain shortcomings. First, attempting to access a stored handgun by accessing the top of a pocket can be difficult and may require the wearer to use both hands to quickly open the pocket. Additionally, by draping the pocket front area upon releasing the entire top and sides of the pocket tends to expose the handgun contained therein which reduces its concealability and limits the element of surprise tactical personnel have over a potential assailant. Therefore, there is a need to provide a garment having a pocket which offers optimum concealability of a handgun while also offering quick and easy access to a handgun or other items stored therein.

SUMMARY OF THE INVENTION

It is an object of the present invention to provide a tactical vest carrier which overcomes the disadvantages of known tactical vest carriers. In one aspect of the present invention, a tactical vest carrier has a pocket for holding and completely enclosing a holster capable of carrying a handgun in which the pocket has one side fixedly secured to the carrier and another side releasably secured to the carrier. A top section of the front flap has a portion that is fixedly secured to the carrier and a releasable portion that is releasably secured to the carrier.

It is a further aspect of the present invention to provide a tactical carrier to be worn over the clothing at a torso region of a wearer in which the tactical vest carrier has a front carrier section and a back carrier section for holding ballistic resistant body armor items inserted therein with the carrier having a pocket extending outwardly from the front carrier section in which the pocket is sized for holding a handgun holster. The pocket has a front flap having a top section, a bottom section, a fixed side section and a releasably securable side section. The bottom section, a fixed portion of the top section and the fixed side section are fixedly secured to the front carrier section. A releasable portion of the top section and the releasably securable side section are releasably secured to the front carrier section of the tactical vest carrier.

BRIEF DESCRIPTION OF THE DRAWINGS

The foregoing advantageous features of the invention will be explained in greater detail and others will be made apparent from the detailed description of the present invention which is given with reference to the several figures of the drawings, in which:

FIG. 4 illustrates the tactical vest with the pocket being worn over the clothing at a torso region of a wearer and the operation of accessing the pocket from the releasable side section of the pocket;

FIG. 5 illustrates a user breaking the releasable securement tabs to access the interior of the pocket from the releasable side section;

FIG. 6 illustrates withdrawal of a handgun from a holster mounted in the pocket of the present invention upon releasable disengagement at the releasable side section and the releasable portion of the top section of the pocket flap; and FIG. 7 further illustrates withdrawal of the handgun from the holster.

DETAILED DESCRIPTION

Figure 1:
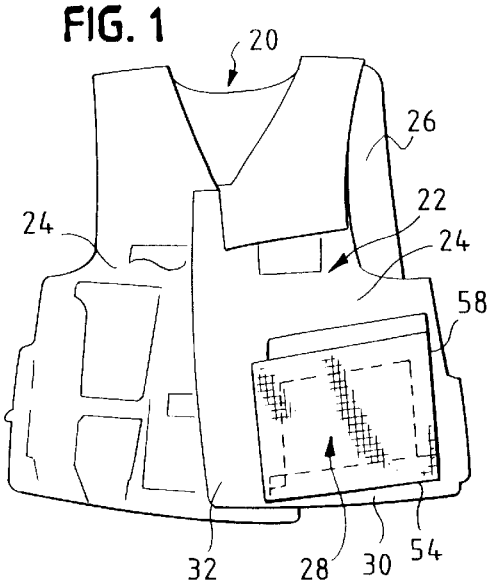
FIG. 1 is a front perspective view of a tactical vest.

Referring to FIG. 1, a tactical vest 20 having an outer tactical vest carrier 22 which is to be worn over the clothing at a torso region of a wearer is shown. The tactical vest carrier 22 is preferably made of durable cloth material such as polyester, nylon and the like. The tactical vest carrier 22 preferably has internal pocket regions for holding ballistic resistant body armor items such as high strength flexible ballistic resistant and/or puncture resistant pads and ballistic resistant plate inserts (not shown) to prevent penetration of high caliber ballistic rounds including assault rifle rounds. As seen in FIG. 1, the carrier 22 has a front carrier section 24 to be worn over the front torso of a wearer and a back carrier section 26 to be worn over the back torso of the wearer. Preferably, both the front carrier section 24 and back carrier section 26 hold ballistic resistant body armor items (not shown) which are inserted therein.

A pocket 28 extends outwardly from the front carrier section 24 of the tactical vest carrier 22. As seen in FIG. 1, the pocket 28 is disposed proximate a lower corner area 30 at a front carrier surface 32 of the front carrier section 24. The pocket 28 is also sized for holding a holster carrying a handgun therein.

Figure 2:
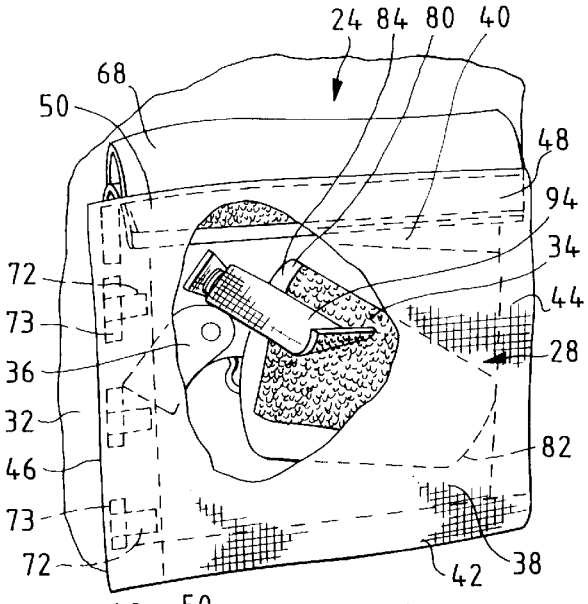
FIG. 2 is an enlarged frontal view of the pocket positioned at the front carrier section of the vest of the present invention illustrating a holster and handgun contained therein.
Figure 3:
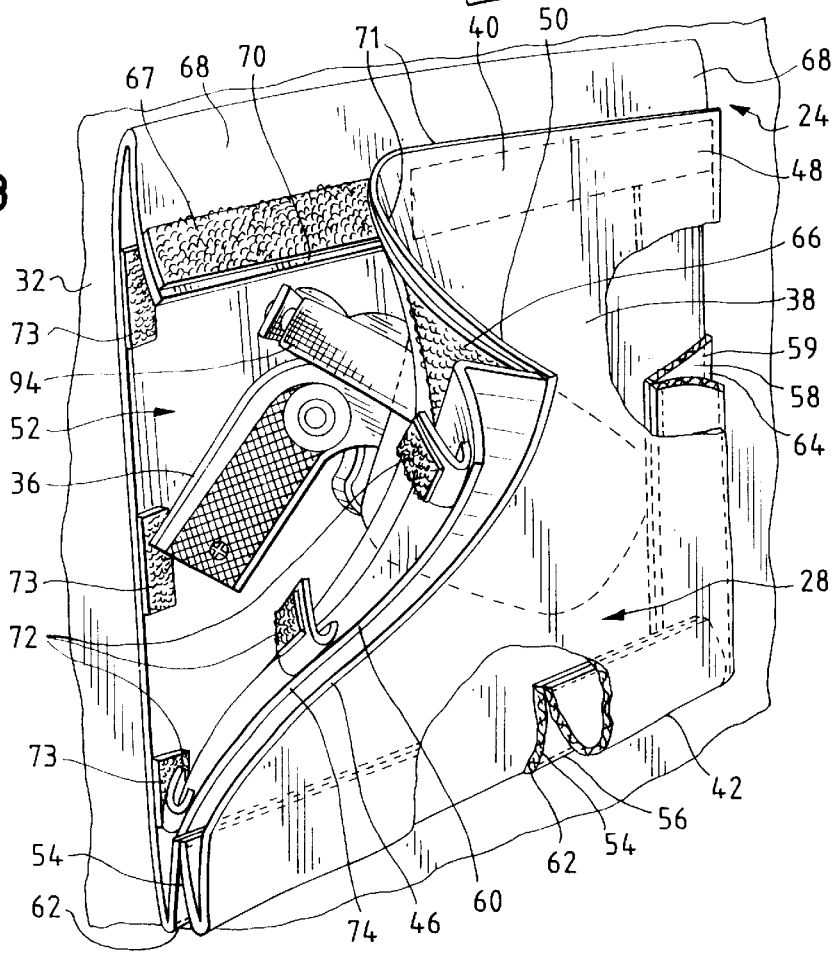
FIG. 3 is a side perspective view of the pocket showing the releasable side section disengaged with the holster and handgun carried in the pocket.

Referring to FIGS. 2 and 3, the pocket 28 is shown containing a holster 34 carrying a handgun 36 within the confines of the pocket. The pocket 28 has a front flap 38 with a top section 40, a bottom section 42, a fixed side section 44 and a releasably securable side section 46. In accordance with the present invention, the bottom section 42, a fixed portion 48 of the top section 40 and the fixed side section 44 are fixedly secured to pocket backing 52 at the front section 24 of the carrier. A releasable portion of the top section 40 and the releasably securable side section 46 are releasably secured to the pocket backing 52 of the tactical vest carrier. As seen in FIG. 3, the pocket backing 52 is secured to the front carrier surface 32 of the front carrier section 24 of the tactical vest carrier 22. The pocket backing 52 is preferably secured by being stitched to the front carrier section 24 at surface 32, however the backing 52 may alternatively be secured by snaps or releasably securable hook and loop fasteners, or both, to the front carrier section. Additionally, in an alternative aspect of the present invention, the pocket backing will include or actually be the front carrier surface 32 of the front carrier section 24 with the bottom section and fixed side section being fixed directly to the front carrier section.

Still referring to FIGS. 2 and 3, the bottom section 42 of the front flap 38 of the pocket 28 includes a bottom flap extension 54 which is fixedly secured to the carrier preferably by stitching. The fixed side section 42 also includes a fixed flap extension 58 which is fixedly attached to the carrier preferably by stitching. The entire bottom edge 62 of the bottom flap extension 54 and the entire side edge 64 of the fixed flap extension are secured to the pocket backing by stitching. The releasably securable side section 46 has a releasable flap extension 60 which is releasably secured to the pocket backing 52.

The fixed portion 48 of the top section 40 of the front flap 38 is stitched to the carrier 22 and the releasable portion 50 of the top section 40 has a strip 66 of releasably securable fastener material for mating securement with a corresponding strip 67 of releasably securable fastener material which is connected at the front carrier section 24. As seen in FIG. 3, extending from the pocket backing 52 is a top flap extension 68 having one end 70 being fixedly secured by stitching to the fixed portion 48 of the top section 40 and also being releasably secured by releasably securable fastener material 67 to the releasable portion 50 of the top section 40 of the front flap 38. The fixed portion 48 and the releasable portion 50 are aligned along the top section 40 proximate a top edge 71 of the front flap 38. The fixed portion 48 generally extends at least one half the length of the top section 40. Preferably, the fixed portion 48 extends approximately three fourths (¾) the length of the top section and the releasable portion 50 extends approximately one fourth (¼) the length of the top section of the front flap 38. By having the fixed portion at the top section of the front flap of the pocket, the top of the pocket does not fully drape down upon accessing the holstered handgun from the releasably securable side section thereby furthering concealment of the gun during removal from the holster.

As seen in FIG. 3, the releasable portion 50 of the top section 40 is adjacent to the releasably securable side section 46 of the front flap 38. The fixed portion 48 of the top section 40 is adjacent to the fixed side section 44 of the flap 38. The releasable flap extension 60 of section 46 has affixed thereon spaced apart mating tabs 72 for releasable securement with a corresponding plurality of tabs 73 at the pocket backing 52 and positioned proximate the front carrier section 24. Preferably, three (3) mating tabs 72 are employed which are spaced substantially equally apart at discrete locations along an edge 74 of the releasable flap extension 60. Hook and loop fastener material is used for the mating tabs 72 of the flap extension 60 and the corresponding tabs 73 proximate the front carrier section 24, however, other releasably securable items such as snaps and the like may suitably be employed.

The holster 34 for carrying hand gun 36 is secured by stitching to the pocket backing 52 or alternatively secured by hook and loop material to the backing and front section 24 of the carrier 22. The holster 34 and the handgun 36 are completely contained within the pocket 28 when the top section 40, bottom section 42, releasable side section 46, and fixed side section 44 are engaged with the front carrier section 24. As seen in FIGS. 2 and 3, the holster 34 tapers from a relatively wide end 80 to a relatively narrow end 82 and has an opening 84 at the wide end for receipt of the handgun 36. The opening 84 at the wide end 80 of the holster 34 faces and is positioned proximate to the releasably securable side section 46 of the front flap 38 of the pocket 28 to enable quick retrieval of the handgun 36 concealably held within the pocket by holster 34.

Referring now to FIGS. 4–7, the operation for quick removal of the handgun 36 from holster 34 held in the inventive pocket 28 of the present invention is shown. In FIG. 4, the user 86 wearing the tactical vest 20 uses his or her shooting arm 88 to move his or her hand into engagement with the releasably securable portion 48 of the pocket 28. With the shooting hand 90 being inserted into the pocket 28, FIG. 5, at the releasably securable section 46, the spaced apart mating tabs 72 are quickly and easily broken from securement with their corresponding tabs 73. The tabs 72, 73 become disengaged and the hand is inserted further into the interior of the pocket toward the handgun 36. As the hand moves into the interior of the pocket 28, the strip 66 of releasable securement material of the top section 40 of the flap 38 becomes disengaged with its mating strip 67 of releasable securement material positioned at the top flap extension 68 as seen in FIG. 6. The user grabs the handgun 36 in the holster 34 and with the thumb moving in an upward direction releases the secured snaps 92 of retainment strap 94 engaged about the hammer of the handgun to secure it within the holster. With the retainment strap 94 disengaged the handgun 36 is removed from the holster 34, FIG. 7, and from the pocket 28 through the opened side section.

As seen in FIGS. 4–7, the method of accessing handgun 36 held in holster 34 contained in pocket 28 secured at the front carrier section 24 of the tactical body armor vest 20 includes the step of pushing against the side section 46, FIGS. 4 and 5, of the pocket to disengage the releasably securable fastener material 72, 73 securing the side section to the vest such that an opening, FIG. 5, is created proximate the side section 46 of the pocket. The spaced apart mating tabs of releasably securable fastener material 72 at discrete locations long the side section of the pocket are disengaged from their corresponding releasably securable tabs 73. Additionally, other releasably securable fastener material 66, FIGS. 3 and 6, positioned between the releasable portion 50 of the top section 40 of the pocket and the tactical vest adjacent to the releasable side section 46 of the pocket is disengaged from releasably securable fastener material 67 to increase the size of the opening. The remaining fixed portion 48 of the top section 40 of the pocket is and remains fixedly secured to the tactical vest. The step of grasping the hand gun 36 from the holster 34 to remove the gun from the pocket, FIGS. 6 and 7, is then performed.

While a detailed description of the preferred embodiments of the invention has been given, it shall be appreciated that many variations can be made thereto without departing from the scope of the invention as set forth in the appended claims.

What is claimed is:

1. A tactical vest carrier to be worn over clothing at a torso region of a wearer in which the tactical vest carrier has a front carrier section and a back carrier section for holding ballistic resistant body armor items inserted therein, the tactical vest carrier comprising:

a pocket extending outwardly from the front carrier section of the tactical vest carrier and in which the pocket is sized for holding a holster therein; and a front flap of the pocket having a top section, a bottom section, a fixed side section and a releasably securable side section in which the bottom section, a fixed portion of the top section and the fixed side section are fixedly secured to a pocket backing and in which a releasable portion of the top section and the releasably securable side section are releasably coupled by a mechanical bond to the pocket backing.

2. The tactical vest carrier of claim 1 in which the pocket backing includes a front carrier surface of the front carrier section.

3. The tactical vest carrier of claim 1 in which the pocket backing is secured to a front carrier surface of the front carrier section.

4. The tactical vest carrier of claim 1 in which the bottom section of the front flap includes a bottom flap extension fixedly secured to the carrier and the fixed side section includes a fixed flap extension fixedly secured to the carrier.

5. The tactical vest carrier of claim 4 in which an entire bottom edge of the bottom flap extension and an entire side edge of the fixed flap extension are secured to the pocket backing by stitching.

6. The tactical vest carrier of claim 1 in which the fixed portion of the top section of the front flap is stitched to the carrier and the releasable portion of the top section has a strip of releasably securable fastener material for mating securement to the front carrier section.

7. The tactical vest carrier of claim 6 including a top flap extension having one end being fixedly secured to the fixed portion of the top section of the front flap and being releasably coupled by releasably securable fastener material to the releasable portion of the top section of the front flap.

8. The tactical vest carrier of claim 7 in which the fixed portion and the releasable portion are aligned along the top section proximate a top edge of the front flap.

9. The tactical vest carrier of claim 1 in which the top section of the front flap has a length and the fixed portion extends approximately three-fourths (¾) the length of the top section and the releasable portion extends approximately one fourth (¼) the length of the top section of the front flap.

10. The tactical vest carrier of claim 1 in which the releasable portion of the top section is adjacent to the releasably securable side section of the front flap and the fixed portion of the top section is adjacent to the fixed side section of the front flap.

11. The tactical vest carrier of claim 1 in which the releasably securable side section includes a releasable flap extension releasably secured to the pocket backing.

12. The tactical vest carrier of claim 11 in which the releasable flap extension includes a plurality of spaced apart mating tabs for releasable engagement with a corresponding plurality of tabs positioned proximate the front carrier section.

13. The tactical vest carrier of claim 12 in which the mating tabs are spaced substantially equally apart at discrete locations along an edge of the releasable flap extension.

14. The tactical vest carrier of claim 13 in which the mating tabs of the releasable flap extension and the corresponding plurality of tabs proximate the front carrier section include hook and loop fastener material.

15. The tactical vest carrier of claim 12 including a holster and means for mounting the holster such that the holster is completely contained within the pocket when said top section, bottom section, releasable side section and fixed side section are engaged with the front carrier section.

16. The tactical vest carrier of claim 15 in which the holster tapers from a relatively wide end to a relatively narrow end and has an opening at the relatively wide end of the holster and in which the opening at the relatively wide end of the holster faces and is positioned proximate to the releasably securable side section of the front flap of the pocket.

17. The tactical vest carrier of claim 16 in which the pocket is disposed proximate a lower corner area at the front carrier surface of the front carrier section.

18. A method of accessing a hand gun held in a holster contained in a pocket secured at a front carrier section of a tactical vest, comprising the steps of:

pushing against a side section of the pocket to disengage releasably coupled fastener material securing the side section to the tactical vest such that an opening is created proximate the side section of the pocket;

disengaging other releasably coupled fastener material positioned between a releasable portion of a top section of the pocket and the tactical vest adjacent the side section of the pocket and in which a fixed portion of the top section of the pocket remains fixedly secured to the tactical vest; and grasping the hand gun from the holster for removal from the pocket.

19. The method of claim 18 in which the step of pushing includes the step of disengaging a plurality of mating tabs of releasably coupled fastener material spaced substantially equally apart at discrete locations along the side section of the pocket.

20. The method of claim 19 in which the side section includes a releasable flap extension releasably secured to the front carrier section of the tactical vest.

* * * * *